US007543696B2

(12) United States Patent
Aulanko et al.

(10) Patent No.: US 7,543,696 B2
(45) Date of Patent: Jun. 9, 2009

(54) HANDRAIL FOR A TRAVELATOR, ESCALATOR OR MOVING RAMP AND METHODS FOR MOUNTING A HANDRAIL BELT ON A HANDRAIL AND REMOVING FROM A HANDRAIL

(75) Inventors: Esko Aulanko, Kerava (FI); Jorma Mustalahti, Hyvinkää (FI); Marc Ossendorf, Bochum (DE)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 11/896,920

(22) Filed: Sep. 6, 2007

(65) Prior Publication Data

US 2008/0053789 A1 Mar. 6, 2008

Related U.S. Application Data

(63) Continuation of application No. PCT/FI2006/000076, filed on Mar. 7, 2006.

(30) Foreign Application Priority Data

Mar. 9, 2005 (FI) ..... 20050258

(51) Int. Cl.
*B66B 23/16* (2006.01)

(52) U.S. Cl. ..... 198/329; 198/336

(58) Field of Classification Search ..... 198/329, 198/336, 813

See application file for complete search history.

(56) References Cited

U.S. PATENT DOCUMENTS

| | | | | |
|---|---|---|---|---|
| 2,660,286 A | | 11/1953 | Margles et al. | |
| 2,686,585 A | | 8/1954 | Margles et al. | |
| 4,266,257 A | | 5/1981 | Rudich, Jr. | |
| 4,319,298 A | | 3/1982 | Davis et al. | |
| 4,739,870 A | * | 4/1988 | Saito | 198/328 |
| 4,928,796 A | | 5/1990 | Poon | |
| 6,092,639 A | * | 7/2000 | Reo | 198/329 |

FOREIGN PATENT DOCUMENTS

| | | |
|---|---|---|
| FI | 20040021 | 7/2005 |
| JP | 50-117188 | 9/1975 |
| JP | 2005-170551 A | 6/2005 |
| JP | 2005-194066 A | 7/2005 |
| SU | 1474065 A1 | 4/1989 |
| WO | WO 2005/066058 A2 | 7/2005 |

* cited by examiner

*Primary Examiner*—James R Bidwell
(74) *Attorney, Agent, or Firm*—Birch, Stewart, Kolasch & Birch, LLP

(57) ABSTRACT

A handrail for a travelator, moving ramp or escalator, wherein the handrail frame (5) of the handrail comprises a first handrail frame part (9) fixedly mounted on the frame of the travelator and a second handrail frame part (10) with a turnaround guide (7) connected to it, the second handrail frame part (10) being guided to be movable in the direction of the handrail with respect to the first handrail frame part (9) between a mounting position (I) and a tensioning position (II), in which mounting position (I) the handrail belt can be removed from the handrail and/or mounted on the handrail, and in which tensioning position (II) the handrail belt is in a tensioned state; and that a tensioning device (8) has been fitted to move the second handrail frame part (10) and to lock it in position relative to the first handrail frame part (9).

15 Claims, 2 Drawing Sheets

Figure 1:
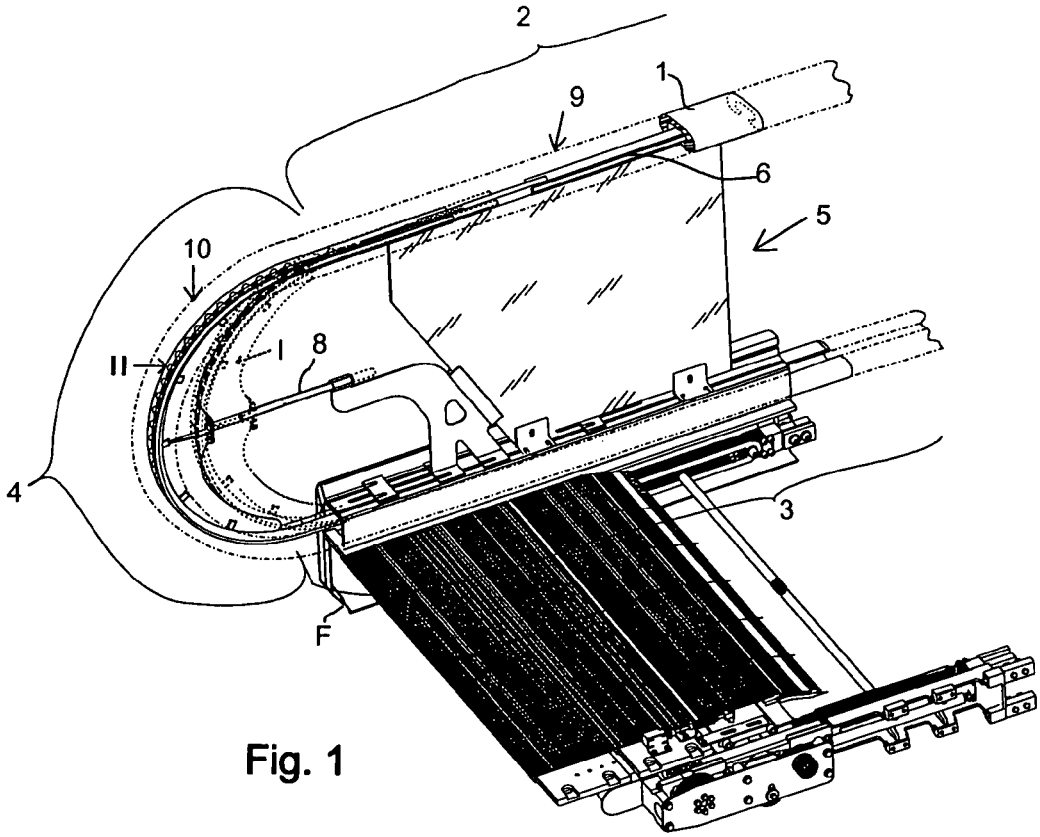

HANDRAIL FOR A TRAVELATOR, ESCALATOR OR MOVING RAMP AND METHODS FOR MOUNTING A HANDRAIL BELT ON A HANDRAIL AND REMOVING FROM A HANDRAIL

This application is a Continuation of copending PCT International Application No. PCT/FI2006/000076 filed on Sep. 9, 2007, which designated the United States, and on which priority is claimed under 35 U.S.C. § 120. This application also claims priority under 35 U.S.C. § 119(a) on Patent Application No(s). 20050258 filed in Finland on Mar. 9, 2005. The entire contents of each of the above documents is hereby incorporated by reference.

FIELD OF THE INVENTION

The present invention relates to a handrail as defined in the preamble of claim 1. Further, the invention relates to a method as defined in claim 12. In addition, the invention relates to a method as defined in claim 13.

BACKGROUND OF THE INVENTION

In prior art, a handrail for a travelator, moving ramp or escalator is known. Such a handrail comprises a handrail belt moving as an endless loop. The handrail belt is moved at a speed synchronized with the speed of motion of the conveyor of the travelator, moving ramp or escalator, so that a passenger on the travelator can grip the upper handhold portion of the handrail by hand for support. At the end of the handrail, the handrail belt is deflected on a turn-around portion through 180° to a return portion in the opposite return direction relative to the direction of motion of the upper handhold portion, the return portion being usually passed inside the frame structures to the other end of the travelator.

The handrail further comprises a handrail frame to support the handrail belt loop, said frame being connected to the frame of the travelator, moving ramp or escalator. The handrail frame comprises an upper guide, which supports and guides the handhold portion of the handrail belt. A turn-around guide having a curved shape, usually the shape of a circular arc, supports and guides the handrail belt in its turn-around portion.

For tensioning of the handrail belt, the handrail belt has to be provided with some kind of tensioning device. Usually the tensioning of the handrail belt is accomplished by arranging in the handrail belt a tensioning loop near the driving pulley, or several loops in the return portion of the handrail belt.

A problem with this prior-art tensioning is that the tensioning wheels required for the tensioning and the turn-around portions bending the handrail belt in different directions and the like take up plenty of space in the frame structures, which is why they are not suited for use in a travelator, moving ramp or escalator designed to be mounted on a base, in which the frame structure should be as low as possible. In addition, bendings of the handrail belt in places other than the end turn-around portion as well as counter-bendings in a different direction than in the end turn-around portion increase the wear of the handrail belt and greatly reduce its service life. Furthermore, in the case of prior-art handrails, mounting and removing the handrail belt is difficult and time-consuming.

OBJECT OF THE INVENTION

The object of the present invention is to overcome the above-mentioned drawbacks.

A specific object of the invention is to disclose a handrail in which the handrail belt undergoes as little bending as possible so that the tensioning requires no extra bending portions and no counter-bending occurs at all.

A further object of the invention is to disclose a handrail wherein the handrail belt undergoes little wear and has a long service life.

Yet another objective of the invention is to disclose easy and economical methods for mounting/removing a handrail belt.

BRIEF DESCRIPTION OF THE INVENTION

The handrail of the invention is characterized by what is disclosed in claim 1. Further, the method of the invention is characterized by what is disclosed in claim 12. Moreover, the method of the invention is characterized by what is disclosed in claim 13.

According to the invention, the handrail frame of the handrail comprises a first handrail frame part, which is fixedly mounted on the frame of the travelator, and a second handrail frame part, to which a turn-around guide is connected. The second handrail frame part is guided to be movable in the direction of the handrail with respect to the first handrail frame part between a mounting position and a tensioning position. In the mounting position, the handrail belt can be removed from the handrail and/or mounted on the handrail. In the tensioning position, the handrail belt is in a tensioned state. A tensioning device has been fitted to move the second handrail frame part and to lock it in position relative to the first handrail frame part.

According to the invention, in the method for mounting a handrail belt on a handrail, the second handrail frame part is moved with respect to the first handrail frame part into the mounting position, in which the length of the perimeter supporting the handrail belt and determined by the handrail frame is smaller than the length of the perimeter of a free non-tensioned handrail belt loop. The handrail belt is then mounted on the frame. Finally, the second handrail frame part is moved with respect to the first handrail frame part into the tensioning position, in which the perimeter determined by the handrail frame and supporting the handrail belt is somewhat larger than the length of the perimeter of a free non-tensioned handrail belt loop to produce a tightening tension in the handrail belt.

According to the method of the invention, to remove the handrail belt from the handrail, the second handrail frame part is moved with respect to the first handrail frame part into the mounting position, in which the length of the perimeter supporting the handrail belt and determined by the handrail frame is smaller than the length of the perimeter of a free non-tensioned handrail belt loop, whereupon the handrail belt is removed from the handrail frame.

The invention has the advantage that, as the tensioning of the handrail belt is accomplished by moving the turn-around guide in the area of the end turn-around portions, the handrail belt only has to bend in its natural bending direction and with a large radius in the end turn-around portions in the area of the turn-around guides and no other bendings or counter-bendings are needed at all for the tensioning, so the handrail belt has a long service life due to reduced wear. The handrail belt can be easily and quickly mounted and removed.

In an embodiment of the handrail, the first handrail frame part comprises a profiled beam mountable on the frame of the travelator. The profiled beam has a hollow interior space, through which the return portion of the handrail belt is guided to run. A plate-like panel is attached to the profiled beam.

Secured to the upper edge of the panel is an upper guide. A supporting element is secured to the profiled beam. A tensioning device has been fitted to act between the supporting element and the second handrail frame part.

In an embodiment of the handrail, the profiled beam comprises a top wall delimiting the interior space in the upward direction. The upper surface of the top wall is provided with longitudinal mounting slots for securing the panel and the supporting element.

In an embodiment of the handrail, the second handrail frame part comprises a guide profile. The guide profile comprises an upper straight first portion, which forms an extension to the upper guide of the first handrail frame part. Moreover, the guide profile comprises a lower straight second portion, fitted in the interior space of the profiled beam. In addition, the guide profile has a curved portion, which forms a turn-around guide and which comprises a number of bearing rollers arranged in a successive array to support the handrail belt from the inner side.

In an embodiment of the handrail, the second handrail frame part is guided to be movable in the direction of the handrail between a mounting position and a tensioning position by means of upper first guide elements and lower second guide elements. The upper guide elements have been fitted to guide the first portion of the guide profile to move in alignment with the upper guide, i.e. in the longitudinal direction of the handrail. The lower second guide elements guide the second portion of the guide profile to move in alignment with the profiled beam.

In an embodiment of the handrail, the top wall of the profiled beam is provided with a first through-longhole oriented in the longitudinal direction of the profiled beam. The second handrail frame part comprises a T-guide element, which is attached to the second portion of the guide profile. The T-guide element comprises a vertical web extending through the first longhole from the inside to the outside of the profiled beam. In addition, the T-guide element comprises a horizontal flange connected to the web and fitted to be supported on the top surface of the profiled beam. The aforesaid second guide elements consist of the first longhole and the web and flange of the T-guide element.

In an embodiment of the handrail, the first portion of the guide profile comprises a second through-longhole. The first handrail frame part comprises an elongated insert profile, which is mounted on the upper edge of the panel and fitted to be slidable inside the first portion of the guide profile. Attached to the insert profile is a projecting peg or the like, which has been fitted to be slidable inside and guided by the second longhole. The aforesaid first guide elements consist of the second longhole, the insert profile and the projecting peg.

In an embodiment of the handrail, the tensioning device is an active telescoping-type power means, such as a pressure-medium operated cylinder or the like.

In an embodiment of the handrail, the tensioning device comprises a threaded bar having an external thread and connected to the second handrail frame part, and a threaded sleeve connected to the first handrail frame part and having an internal thread, on which the threaded bar has been fitted to be turned.

In an embodiment of the handrail, the threaded sleeve is connected to the supporting element.

In an embodiment of the handrail, the tensioning device has been arranged in the middle region of the handrail as seen in the vertical direction, at substantially equal vertical distances from the first portion and the second portion of the guide profile.

LIST OF FIGURES

Figure 2:
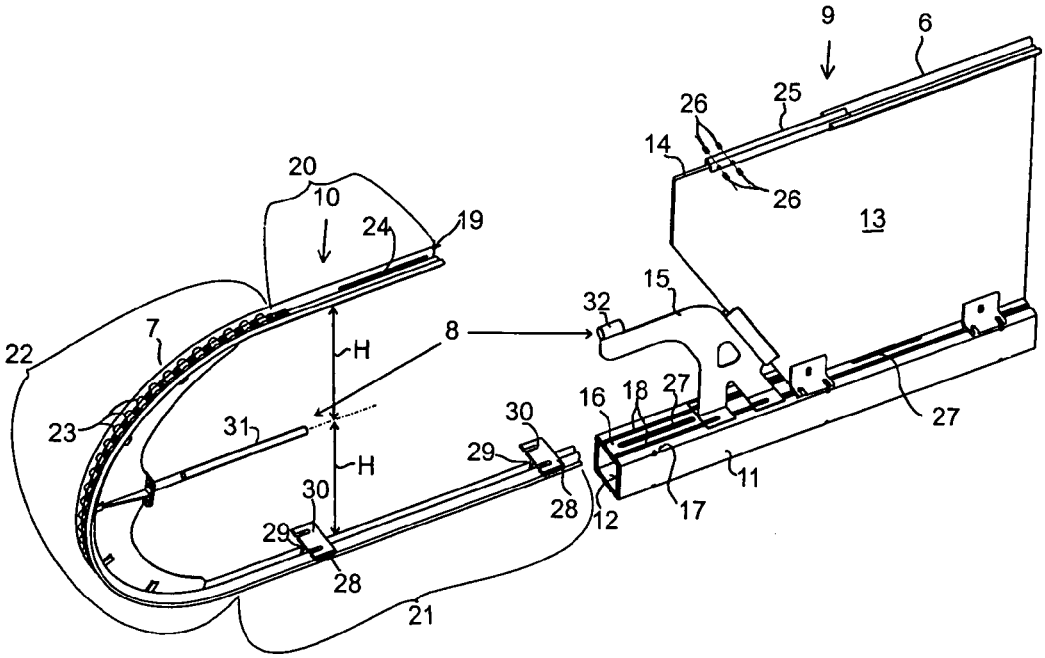
Figure 3:
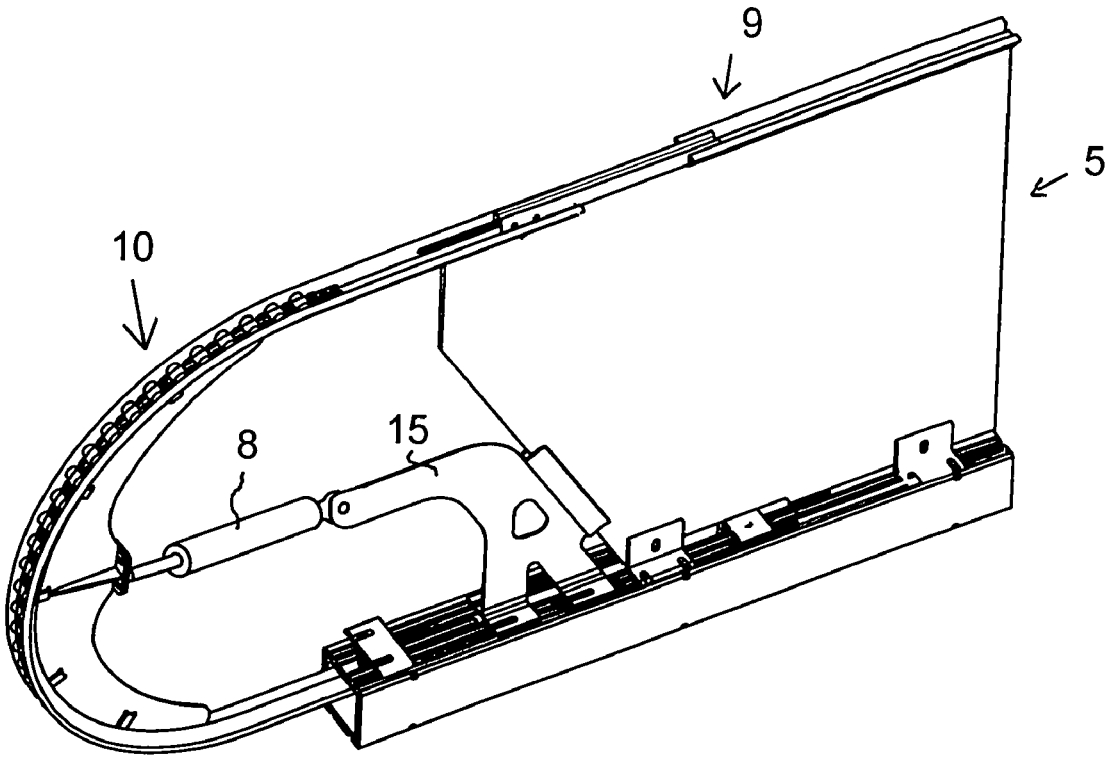

In the following, the invention will be described in detail with reference to embodiment examples and the attached drawing, wherein FIG. 1 presents an axonometric oblique top view of one end of a travelator, moving ramp or escalator provided with an embodiment of the handrail of the invention, FIG. 2 presents the first and second handrail frame parts in separation from each other, and FIG. 3 presents an axonometric oblique top view of another embodiment of the handrail of the invention.

DETAILED DESCRIPTION OF THE INVENTION

FIG. 1 shows a diagrammatic view of part of the end of a travelator, moving ramp or escalator and a handrail placed on one side of it. The handrail comprises a handrail belt 1, which has been arranged to move as an endless loop. In FIG. 1, part of the handrail belt is depicted in outline with dotted broken lines. The handrail belt 1 has an upper handhold portion 2, which the passenger on the travelator can grasp with a hand for support, and a lower return portion 3 and an end turn-around portion 4. In the end turn-around portion 4, the return portion 3 turns around with a 180° curvature to become the handhold portion 2, and vice versa.

The handrail frame 5 is supported on the frame F of the travelator. The handrail frame 5 comprises an upper guide 6, which supports and guides the handhold portion 2 of the handrail belt loop. Further, the handrail frame 5 comprises a curved turn-around guide 7 to support and guide the end turn-around portion.

The handrail frame 5 comprises a fixed first handrail frame part 9, which is fixedly mounted on the frame F of the travelator, and a movable second handrail frame part 10, to which the turn-around guide 7 is connected. The second handrail frame part 10 is guided to be movable in the direction of the handrail with respect to the first handrail frame part 9 between a mounting position I and a tensioning position II. In the mounting position I, the handrail belt can be removed from the handrail and/or mounted on the handrail, because in that position the length of the perimeter supporting the handrail belt 1 and determined by the handrail frame 5 is smaller than the length of the perimeter of a free non-tensioned handrail belt loop. In the tensioning position II, the handrail belt 1 is in a tensioned state, because in that position the length of the perimeter supporting the handrail belt 1 and determined by the handrail frame 5 is somewhat greater than the length of the perimeter of a free non-tensioned handrail belt loop to produce a tightening tension in the handrail belt 1.

The second handrail frame part 10 is moved and locked in position relative to the first handrail frame part 9 by means of a tensioning device 8.

Referring to 2, the first handrail frame part 8 comprises a profiled beam 11 mounted on top of the frame F of the travelator.

The profiled beam has a hollow interior space 12, through which the return portion 3 of the handrail belt is guided to run, as can be seen from FIG. 1. A plate-like panel 13 is secured with fastening elements to the profiled beam 11. The profiled beam 11 comprises a top wall 16 delimiting the interior space 12 in the upward direction, the upper surface 17 of the top wall being provided with longitudinal mounting slots 18, which are bolt slots to which the panel 13 can be fastened by bolted joints. The upper guide 6 is secured to the upper edge 14 of the panel to support and guide the handhold portion of the handrail belt. The supporting element 15 is likewise secured by bolted joints to the mounting slots 18 of the profiled beam 11.

In the embodiment in FIGS. 1 and 2, the tensioning device 8 comprises a threaded bar 31 connected to the second handrail frame part 10 and having an external thread. Connected to the supporting element 15 is a threaded sleeve 32 provided with an internal thread, the threaded bar 31 being fitted to be screwed into this sleeve.

The second handrail frame part 10 comprises a guide profile 19 bent to a U-shaped form such that it has an upper straight first portion 20, a lower straight second portion 21 and a curved portion 22.

The upper first portion 20 forms an extension to the upper guide 6 of the first handrail frame part 9. The lower second portion 21 is fittable in the interior space 12 of the profiled beam 11. The curved portion 22 forms a turn-around guide 9. Supported with bearings on the curved portion are a number of bearing rollers 23 in a successive array, which serve as bearings supporting the handrail belt from the inner side.

The second handrail frame part 10 is guided to be movable in the direction of the handrail between a mounting position I and a tensioning position II by means of upper first guide elements 24, 25, 26, which have been fitted to guide the first portion 20 of the guide profile 19 to move in alignment with the upper guide 6, and by means of lower second guide elements 27, 28, 29, 30, which have been fitted to guide the second portion 21 of the guide profile 19 to move in alignment with the profiled beam 11.

The top wall 16 of the profiled beam 11 is provided with a first through-longhole 27 oriented in the longitudinal direction of the profiled beam. In the example in FIG. 2, the profiled beam has two such longholes at a distance from each other. Attached to the second handrail frame part 10 are correspondingly two T-guide elements 28, which are attached to the second portion 21 of the guide profile at a distance from each other. The T-guide element 28 comprises a vertical web 29, which can extend through the first longhole 27 from the inside to the outside of the profiled beam, and a horizontal flange 30 connected to the web 29 and fitted to rest on the top surface 17 of the profiled beam. The lower second guide elements thus consist of the first longhole 27 and the web 29 and flange 30 of the T-guide element 28.

The first portion 20 of the guide profile 19 comprises two second through-longholes 24, placed in mutual alignment on opposite sides of the guide profile. The first handrail frame part 9 comprises an elongated insert profile 25, which is mounted on the upper edge 14 of the panel 13 and fitted to be slidable inside the first portion 20 of the guide profile during the tensioning motion between positions I and II. Attached to the insert profile 25 are projecting pegs 26, which have been fitted to be slidable inside and guided by the second longholes 24. The upper first guide elements thus consist of the second longholes 24, the insert profile 25 and the projecting peg 26.

The tensioning device 8 has been arranged in the middle region of the handrail as seen in the vertical direction, at substantially equal vertical distances from the first portion 20 and the second portion 21 of the guide profile 19.

FIG. 3 illustrates that the tensioning device 8 may also be an active telescoping-type power means, such as a pressure-medium operated cylinder or the like, applying a continuous tensioning force on the handrail belt from the first handrail frame part 9 e.g. by continuously forcing the second handrail frame part 10 away from the first handrail frame part 9.

The invention is not exclusively limited to the embodiment examples described above; instead, many variations are possible within the scope of the inventive concept defined in the claims.

The invention claimed is:

1. A handrail for a travelator, moving ramp or escalator, said handrail comprising a handrail belt, which has been arranged to move as an endless loop having an upper handhold portion, which a passenger on the travelator can grasp with a hand for support, and a lower return portion and an end turn-around portion where the return portion turns around so as to become the handhold portion and vice versa at the ends of the travelator, a handrail frame connected to the frame and comprising an upper guide for supporting and guiding the handhold portion, and a curved turn-around guide for supporting and guiding the end turn-around portion, and a tensioning device for tensioning the handrail belt, wherein the handrail frame comprises a first handrail frame part, which is fixedly mounted on the frame of the travelator, and a second handrail frame part, to which the turn-around guide is connected and, wherein the second handrail frame part is adapted to be movable in the direction of the handrail with respect to the first handrail frame part between a mounting position and a tensioning position, in which mounting position the handrail belt can be removed from the handrail and/or mounted on the handrail, and in which tensioning position the handrail belt is in a tensioned state; and further comprising a tensioning device located between the first handrail frame part and the second handrail frame part and directly attached to the first handrail frame part to move the second handrail frame part between the mounting position and the tensioning position and to lock it in position relative to the first handrail frame part.

2. A handrail according to claim 1, wherein the second handrail frame part is adapted to be movable in the direction of the handrail between a mounting position and a tensioning position by means of upper first guide elements, which have been fitted to guide the first portion of the guide profile to move in alignment with the upper guide, and by means of lower second guide elements, which have been fitted to guide the second portion of the guide profile to move in alignment with the profiled beam.

3. A handrail according to claim 1, wherein the tensioning device is an active telescoping-type power means.

4. A handrail according to claim 1, wherein the tensioning device comprises a threaded bar connected to the second handrail frame part and having an external thread, and a threaded sleeve connected to the first handrail frame part and provided with an internal thread, on which the threaded bar has been fitted to be turned.

5. A handrail according to claim 4, wherein the threaded sleeve is connected to the supporting element.

6. A handrail according to claim 1, wherein the tensioning device has been fitted between the first handrail frame part and the second handrail frame part to act so as to move the second handrail frame part and to lock it in position relative to the first handrail frame part.

7. A method for mounting a handrail belt on a handrail as defined in claim 1, comprising:

moving the second handrail frame part with respect to the first handrail frame part into a mounting position, in which the length of the perimeter supporting the handrail belt and determined by the handrail frame is smaller than the length of the perimeter of a free non-tensioned handrail belt loop, mounting the handrail belt on the handrail frame, moving the second handrail frame part with respect to the first handrail frame part into a tensioning position, in which the length of the perimeter supporting the handrail belt and determined by the handrail frame is somewhat greater than the length of the perimeter of a free non-tensioned handrail belt loop to produce a tightening tension in the handrail belt; and directly attaching the tensioning device to the first handrail frame part.

8. The method of mounting a handrail according to claim 7, comprising:

moving the second handrail frame part with respect to the first handrail frame part into the mounting position using the tensioning device fitted to act between the first handrail frame part and the second handrail frame part; and moving the second handrail frame part with respect to the first handrail frame part into the tensioning position using the tensioning device fitted to act between the first handrail frame part and the second handrail frame part.

9. A method for removing a handrail belt from a handrail as defined in claim 1, comprising:

directly attaching the tensioning device to the first handrail frame part;

moving the second handrail frame part with respect to the first handrail frame part into the mounting position, in which the length of the perimeter supporting the handrail belt and determined by the handrail frame is smaller than the length of the perimeter of a free non-tensioned handrail belt loop, and moving the handrail belt from the handrail frame.

10. A handrail according to claim 1, wherein the first handrail frame part comprises a profiled beam portion, and the second handrail part and is directly attached to a profiled beam portion of the first handrail frame part.

11. A handrail for a travelator, moving ramp or escalator, said handrail comprising a handrail belt, which has been arranged to move as an endless loop having an upper handhold portion, which a passenger on the travelator can grasp with a hand for support, and a lower return portion and an end turn-around portion where the return portion turns around so as to become the handhold portion and vice versa at the ends of the travelator, a handrail frame connected to the frame and comprising an upper guide for supporting and guiding the handhold portion, and a curved turn-around guide for supporting and guiding the end turn-around portion, and a tensioning device for tensioning the handrail belt, wherein the handrail frame comprises a first handrail frame part, which is fixedly mounted on the frame of the travelator, and a second handrail frame part, to which the turn-around guide is connected and which second handrail frame part is guided to be movable in the direction of the handrail with respect to the first handrail frame part between a mounting position and a tensioning position, in which mounting position the handrail belt can be removed from the handrail and/or mounted on the handrail, and in which tensioning position the handrail belt is in a tensioned state; and that a tensioning device has been fitted to move the second handrail frame part and to lock it in position relative to the first handrail frame part, wherein the first handrail frame part comprises a profiled beam, which is mountable on the frame of the travelator and which profiled beam has a hollow interior space through which the return portion of the handrail belt is guided to run, a plate-like panel attached to the profiled beam, the upper guide being secured to the upper edge of said panel, and a supporting element secured to the profiled beam, the tensioning device being fitted to act between said supporting element and the second handrail frame part.

12. A handrail according to claim 11, wherein the profiled beam comprises a top wall delimiting the interior space in the upward direction, an upper surface of said top wall being provided with longitudinal mounting slots for securing the panel and the supporting element.

13. A handrail according to claim 11 or 12, wherein the second handrail frame part comprises a guide profile comprising an upper straight first portion, which forms extension to the upper guide of the first handrail frame part, a lower straight second portion fitted in the interior space of the profiled beam a curved portion forming a turn-around guide and comprising a number of bearing rollers arranged in a successive array to support the handrail belt from its inner side.

14. A handrail for a travelator, moving ramp or escalator, said handrail comprising a handrail belt, which has been arranged to move as an endless loop having an upper handhold portion, which a passenger on the travelator can grasp with a hand for support, and a lower return portion and an end turn-around portion where the return portion turns around so as to become the handhold portion and vice versa at the ends of the travelator, a handrail frame connected to the frame and comprising an upper guide for supporting and guiding the handhold portion, and a curved turn-around guide for supporting and guiding the end turn-around portion, and a tensioning device for tensioning the handrail belt, wherein the handrail frame comprises a first handrail frame part, which is fixedly mounted on the frame of the travelator, and a second handrail frame part, to which the turn-around guide is connected and which second handrail frame part is guided to be movable in the direction of the handrail with respect to the first handrail frame part between a mounting position and a tensioning position, in which mounting position the handrail belt can be removed from the handrail and/or mounted on the handrail, and in which tensioning position the handrail belt is in a tensioned state; and that a tensioning device has been fitted to move the second handrail frame part and to lock it in position relative to the first handrail frame part, wherein a top wall of the profiled beam is provided with a first through-longhole oriented in the longitudinal direction of the profiled beam; and that the second handrail frame part comprises a T-guide element, which is attached to the second portion of the guide profile, and which T-guide element comprises a vertical web extending through the first longhole from the inside to the outside of the profiled beam, and a horizontal flange connected to the web and fitted to be supported on a top surface of the profiled beam, the aforesaid second guide elements thus consisting of the first longhole and the web and flange of the T-guide element.

15. A handrail for a travelator, moving ramp or escalator, said handrail comprising a handrail belt, which has been arranged to move as an endless loop having an upper handhold portion, which a passenger on the travelator can grasp with a hand for support, and a lower return portion and an end turn-around portion where the return portion turns around so as to become the handhold portion and vice versa at the ends of the travelator, a handrail frame connected to the frame and comprising an upper guide for supporting and guiding the handhold portion, and a curved turn-around guide for supporting and guiding the end turn-around portion, and a tensioning device for tensioning the handrail belt, wherein the handrail frame comprises a first handrail frame part, which is fixedly mounted on the frame of the travelator, and a second handrail frame part, to which the turn-around guide is connected and which second handrail frame part is guided to be movable in the direction of the handrail with respect to the first handrail frame part between a mounting position and a tensioning position, in which mounting position the handrail belt can be removed from the handrail and/or mounted on the handrail, and in which tensioning position the handrail belt is in a tensioned state; and that a tensioning device has been fitted to move the second handrail frame part and to lock it in position relative to the first handrail frame part, wherein the second handrail frame part is guided to be movable in the direction of the handrail between a mounting position and a tensioning position by means of upper first guide elements, which have been fitted to guide the first portion of the guide profile to move in alignment with the upper guide, and by means of lower second guide elements, which have been fitted to guide the second portion of the guide profile to move in alignment with the profiled beam, and wherein the first portion of the guide profile comprises a second through-longhole; and that the first handrail frame part comprises an elongated insert profile, which is mounted on the upper edge of the panel and fitted to be slidable inside the first portion of the guide profile, and to which insert profile is attached a projecting peg, fitted to be slidable inside and guided by the second longhole, the aforesaid first guide elements thus consisting of the second longhole, the insert profile and the projecting peg.

* * * * *